US006085834A

United States Patent [19]

Thomas et al.

[11] Patent Number: 6,085,834

[45] Date of Patent: Jul. 11, 2000

[54] AIR HANDLING SYSTEM

[75] Inventors: Patricia T. Thomas, Fort Myers, Fla.; Richard S. Pautz, San Antonio, Tex.

[73] Assignee: Munters Corporation, Fort Myers, Fla.

[21] Appl. No.: 09/160,066

[22] Filed: Sep. 24, 1998

[51] Int. Cl.[7] ..... F24F 13/08; F24F 13/12

[52] U.S. Cl. ..... 165/284; 165/103; 454/255

[58] Field of Search ..... 165/103, 284; 454/328, 236, 233, 255, 296; 237/12.3 A

[56] References Cited

U.S. PATENT DOCUMENTS

| | | | |
|---|---|---|---|
| Re. 35,153 | 2/1996 | Chiu | 261/26 |
| 2,190,242 | 2/1940 | Neiman | 454/236 |
| 2,213,082 | 8/1940 | Dale | 165/248 |
| 3,522,841 | 8/1970 | Spyros Papalexiou | 165/103 |
| 3,618,659 | 11/1971 | Rawal | 454/236 |
| 3,640,307 | 2/1972 | Drzala | 454/255 |
| 4,403,649 | 9/1983 | Herschel et al. | 165/103 |
| 4,534,507 | 8/1985 | Matsuda | 237/12.3 A |
| 5,053,064 | 10/1991 | Hama et al. | 454/236 |
| 5,495,724 | 3/1996 | Koster | 454/296 |
| 5,787,977 | 8/1998 | Yuasa et al. | 165/284 |

*Primary Examiner*—Ira S. Lazarus
*Assistant Examiner*—Tho Duong
*Attorney, Agent, or Firm*—Fitzpatrick, Cella, Harper & Scinto

[57] ABSTRACT

An air handling system for heating, ventilating and air-conditioning systems to provide a variable air flow between an air treatment section and an air bypass section includes selectively sliding panels to vary the air flow between the air treatment section and the bypass section. Positioning of the panels can direct the flow of incoming air to be conditioned from all incoming air flowing through the air treatment section to all incoming air flowing through the bypass section and a mixture of incoming air flowing through the air treatment section and the bypass section.

17 Claims, 10 Drawing Sheets

AIR HANDLING SYSTEM

BACKGROUND OF THE INVENTION

1. Field of the Invention

The invention is directed to an air handling system to control the volume of air flowing through an air treatment system in a heating, ventilating and air conditioning system. More particularly, the air handling system of the present invention selectively varies the volume of air which flows through an air treatment system so that when climatic conditions dictate that it is not necessary to cool, heat, humidify or dehumidify all of the volume of incoming air a portion of the incoming air is diverted to a bypass section to pass untreated to the building.

2. Background of the Invention

In conditioning air for larger commercial buildings such as office building, hotels, apartment building and other commercial establishments, it is often unnecessary due to ambient climatic conditions to treat all of the incoming air before distribution through the building. These air treatment systems known as heating, ventilating and air conditioning (HVAC) systems are used to cool incoming air in summer months, heat incoming air in winter months and, depending upon the ambient humidity level of the air to be treated, either humidify or dehumidify the air before ultimate distribution in the building.

Accordingly, most modern HVAC systems have provisions to bypass a volume of incoming air so that the volume of bypassed air is untreated in the cooling, heating humidifying or dehumidifying system. This is sensible and desirable from an economic standpoint as ambient air conditions may dictate that it is unnecessary to treat the total volume of air distributed in a building. On hot humid days a greater volume, if not the total volume of incoming air, is cooled and dehumidified. On the other hand, on a cooler less humid summer day the ambient air may be sufficiently cool and dry so as to be directly distributed within a building without requiring cooling or dehumidification. Similar conditions may exist in winter months on warmer days. Ambient air conditions may also dictate that it is unnecessary to treat the total volume of incoming air but only a portion of the incoming air volume so that part of the air is passed through the HVAC treating system and part of the air volume is directed to bypass the HVAC treatment system to be mixed with the volume of treated air before ultimate distribution throughout the building.

The HVAC industry has recognized the benefit of air bypass systems and has sought to accommodate air bypass systems in various ways, including various types of movable gates, diverter plates or vanes, and dampers and also by limiting the volume of incoming fresh ambient air by recirculation of a portion of the already conditioned and treated air rather than exhausting it to the outside. Such solutions while attempting to address the problem have not been entirely successful and have not succeeded in completely solving problems inherent in such prior systems.

Problems exist in adequate proportioning of conditioned and bypass air due to differences in pressure drops between air moving through a conditioner and air moving through an air bypass system. Problems also exist in bypass systems which use pivoting dampers or vanes because the change in air volumes is not a linear relationship to the movement of the dampers or vanes making control schemes difficult. Further, these systems can never truly seal the flow of air between the air bypass passage and the air passage through the conditioning portion of the system. Thus, leakage of air occurs between the bypass passages and the conditioning passages so that precise control of the volume of air to be conditioned and the volume of air to be bypassed is not feasibly possible.

Accordingly there presently exists a need for an improved conditioned/air bypass system to provide improved and enhanced operation to maximize the benefits of commercial HVAC systems which operate by regulating the volume of air to be conditioned based on the characteristics of outside ambient air at the time the HVAC system is conditioning air for the interior of a building.

SUMMARY OF THE INVENTION

An improved air handling system for HVAC systems includes, in one preferred embodiment, a plurality of spaced evaporative humidifiers to provide a source of water vapor to humidify a volume of incoming air passing therethrough. Between the evaporative humidifiers an air bypass passageway is provided which allows the incoming air to bypass the evaporative humidification system. A series of movable panels are employed in the incoming air flow duct ahead of the evaporative humidifiers and transverse to the direction of air flow. In one position the panels cover the air inlet to the evaporative humidification system to block air flow therethrough and in a second position are across the air inlet to the air bypass system to block air flow through the bypass passages. At intermediate positions between the first and second positions the panels allow a portion of the incoming air to flow through both the evaporative humidifier and the air bypass system. More or less air flow to either the evaporative humidifiers or the air bypass is controlled by the relative position of the movable panels which slide along a track system.

In a second embodiment more precision and more precise control of the pressure drop of air across the evaporative humidifier and the air bypass system is achieved by having the air pass through a perforated plate in front of both the evaporative humidifier and air bypass where the size and spacing of the perforations provide the desired uniformity in pressure drop.

The bypass system of the present invention is also applicable to other HVAC functions as it can be used in the air flow stream in air cooling and/or heating units as well as dehumidification systems or combinations of heating, cooling, humidification and/or dehumidification systems. It can also be used as an air handling system where recirculated air that has already been conditioned is recirculated and mixed with untreated ambient air to be circulated through a building. In this instance the recirculated air passes through what is the conditioning zone and the untreated ambient air passes through the bypass section.

It is an object of the present invention to provide an air handling system for HVAC systems which permits ready and simple balance of incoming air flow between the IVAC unit and an air bypass.

It is a further object of the present invention to provide an air handling system for HVAC systems which permits selective linear proportioning of untreated incoming air with treated incoming air to maximize the efficiency of the HVAC system.

A further object of the present invention is to provide an air balancing system to balance the flow of incoming air to be treated in an HVAC system where the balance is effected by selective positioning of slidable panels which provide a simple but sturdy mechanism to achieve the desired result.

A still further object of the present invention is to provide an air handling system for an HVAC system where the balance of the flow of incoming air between an air bypass passage and passage through an HVAC treatment portion is achieved with a more uniform differential pressure drop to alleviate problems associated with pressure balancing of equipment upstream or downstream of the air handling system.

BRIEF DESCRIPTION OF THE DRAWINGS

A more complete understanding of the invention will be derived from the description of preferred embodiments when read in conjunction with the accompanying drawings in which.

DESCRIPTION OF THE PREFERRED EMBODIMENTS

Figure 1A:
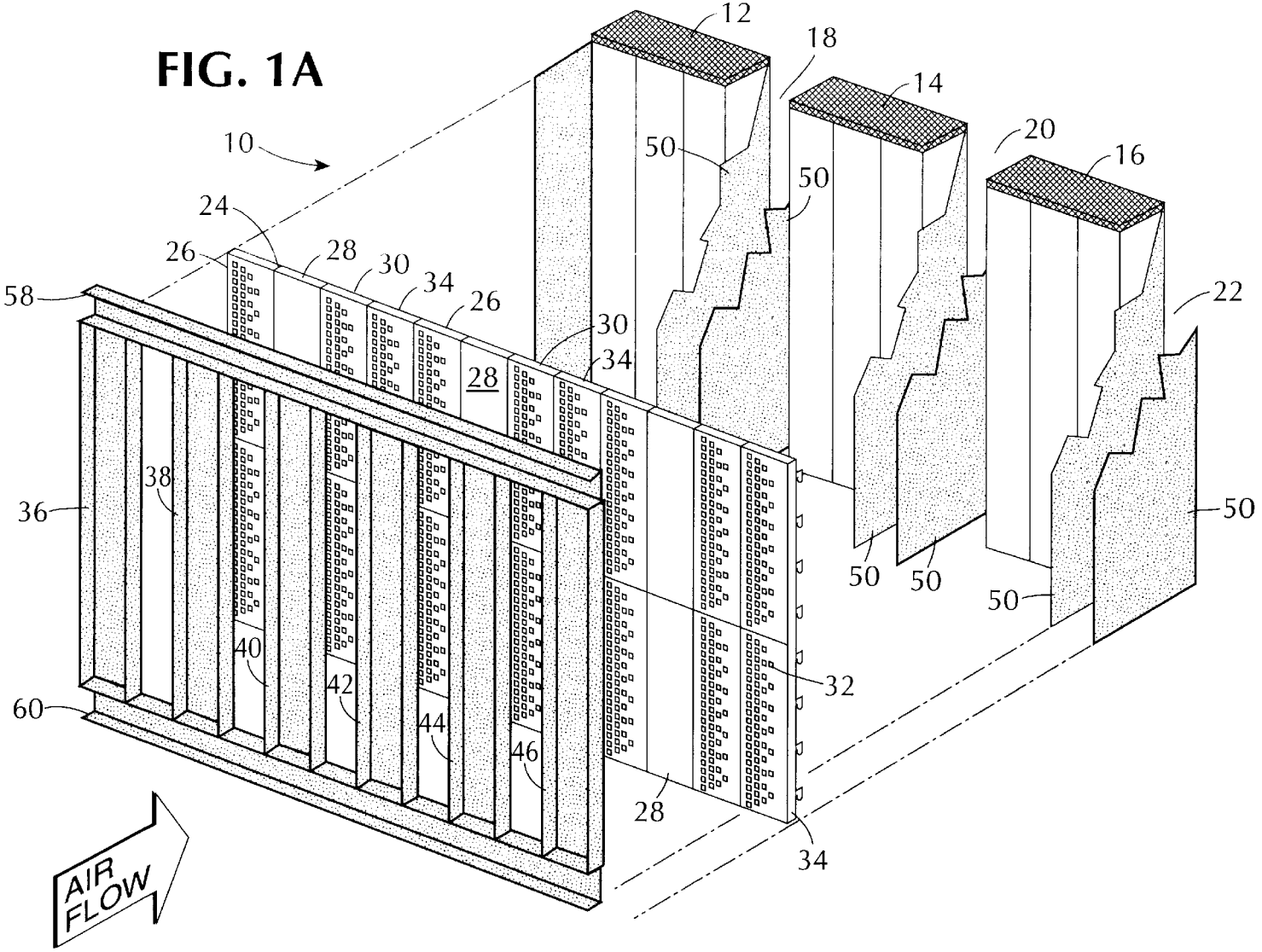
FIG. 1A is an exploded isometric view of one embodiment of the present invention.

The air handling system 10 of the present invention as seen initially in FIG. 1A includes, for one preferred embodiment, a plurality of spaced conditioning cores 12, 14 and 16 and unimpeded air bypass sections 18, 20 and 22 adjacent each conditioning core. The conditioning core, depending upon the desired conditioning conditions can be a cooling unit to cool incoming air, a heating unit to heat incoming air, a combined heating and cooling unit, a humidification unit or a dehumidification unit. Alternatively the conditioning core can be a combination of a heating, cooling humidifying or dehumidifying unit to accommodate any desired air treatment. The conditioning core units may be any standard type unit to accomplish heating, cooling, humidification and/or dehumidification as will be apparent to anyone skilled in the HVAC art. The particular type of core conditioning unit forms no part of the present invention.

Ambient air flows into the air handling systems 10 in the direction of the arrow as indicated. In a preferred embodiment, immediately upstream of the conditioning cores 12, 14 and 16 and the bypass passages 18, 20 and 22 in relatively close juxtaposition are a series of plates 24 extending the full vertical height of the cores 12–16 and bypass passages 18–22. Preferably, adjacent each conditioning core are disposed three such plates 26, 28 and 30. The outside plates 26 and 30 are provided with a plurality of perforations 32 while the middle plate 28 or blanking plate has no perforations. Air flow through the cores is possible through perforated plates 26 and 30 but no air flows through the cores through blanking plate 28. In like manner a perforated plate 34 is disposed in front of bypass passages 18–22 so that air flows through the bypass passages through perforations 32.

To control the volume of air flowing to the conditioning cores 12–16 and the bypass sections 18–20 a series of laterally movable panels 36, 38, 40, 42, 44 and 46 are provided. As will be explained more fully hereinafter, panels 36–46 are mounted in a track assembly 48 for selective slidable movement between a first position where the total volume of incoming air is directed through the air bypass passages 18–22 to a second position where the total volume of incoming air is directed to pass through the conditioning cores 12–16. The respective passages, either through the bypass passages or through the conditioning cores are defined by side plates 50 which extend outwardly from the face of the conditioning cores. When the panels 36–46 are positioned at intermediate positions a volume of incoming air passes through both the conditioning cores and through the bypass sections. The relative position of the movable panels determines the relative volume of air directed to pass through the conditioning cores and through the bypass sections.

Figure 1B:
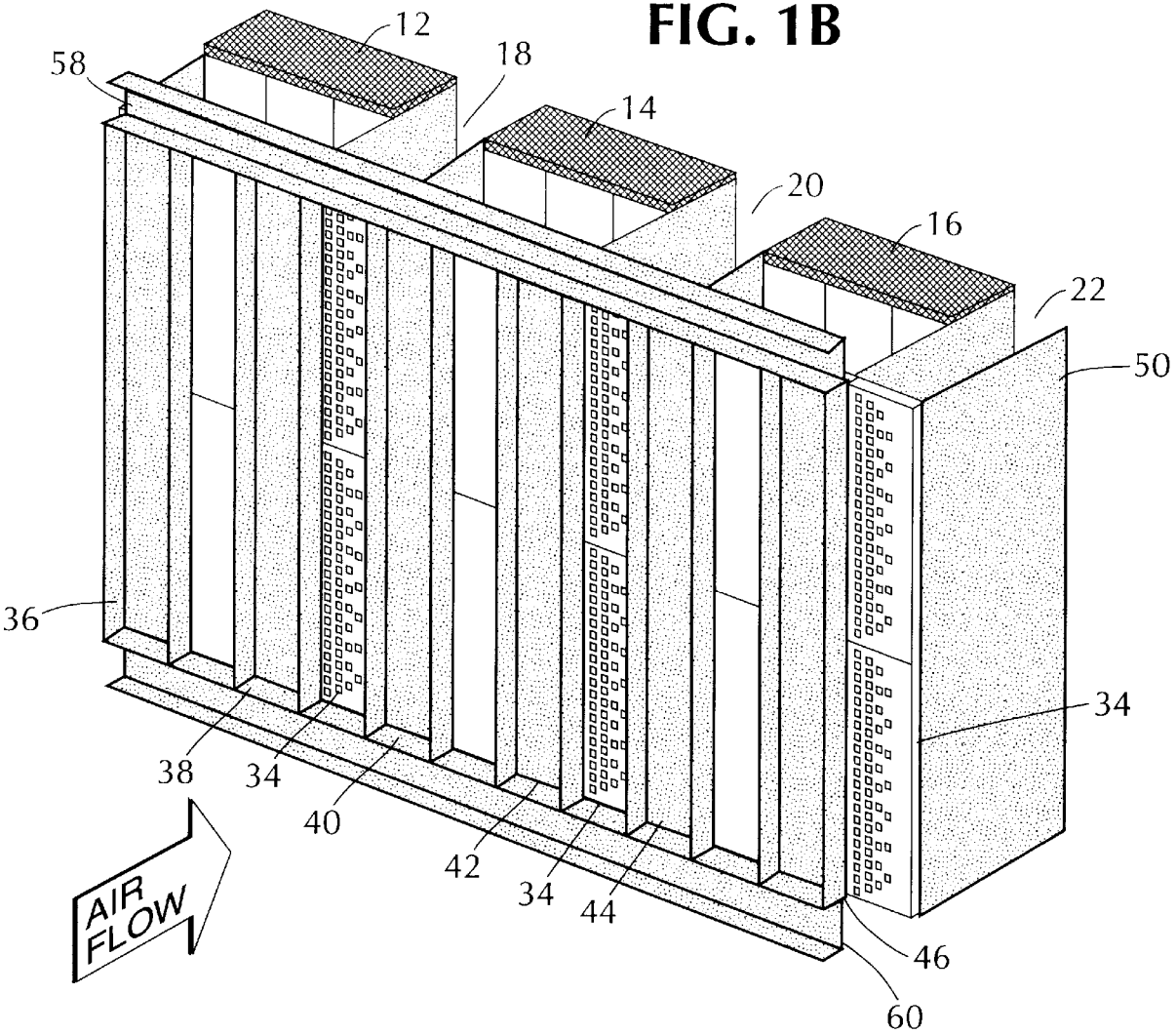
FIG. 1B is an isometric view of a preferred embodiment of the present invention in one selected position of operation.
Figure 1C:
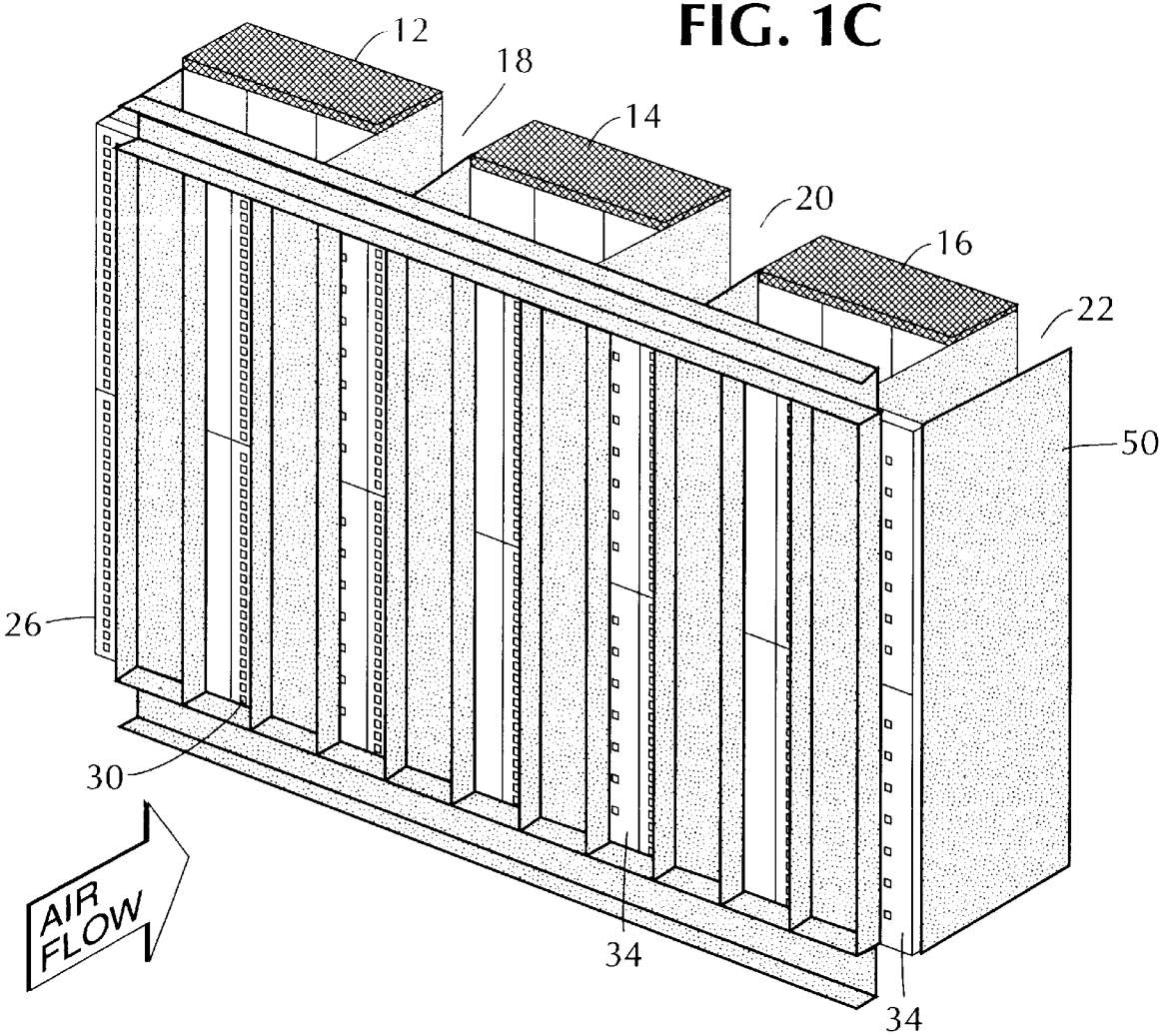
FIG. 1C is a view similar to FIG. 1B showing another position of operation.
Figure 1D:
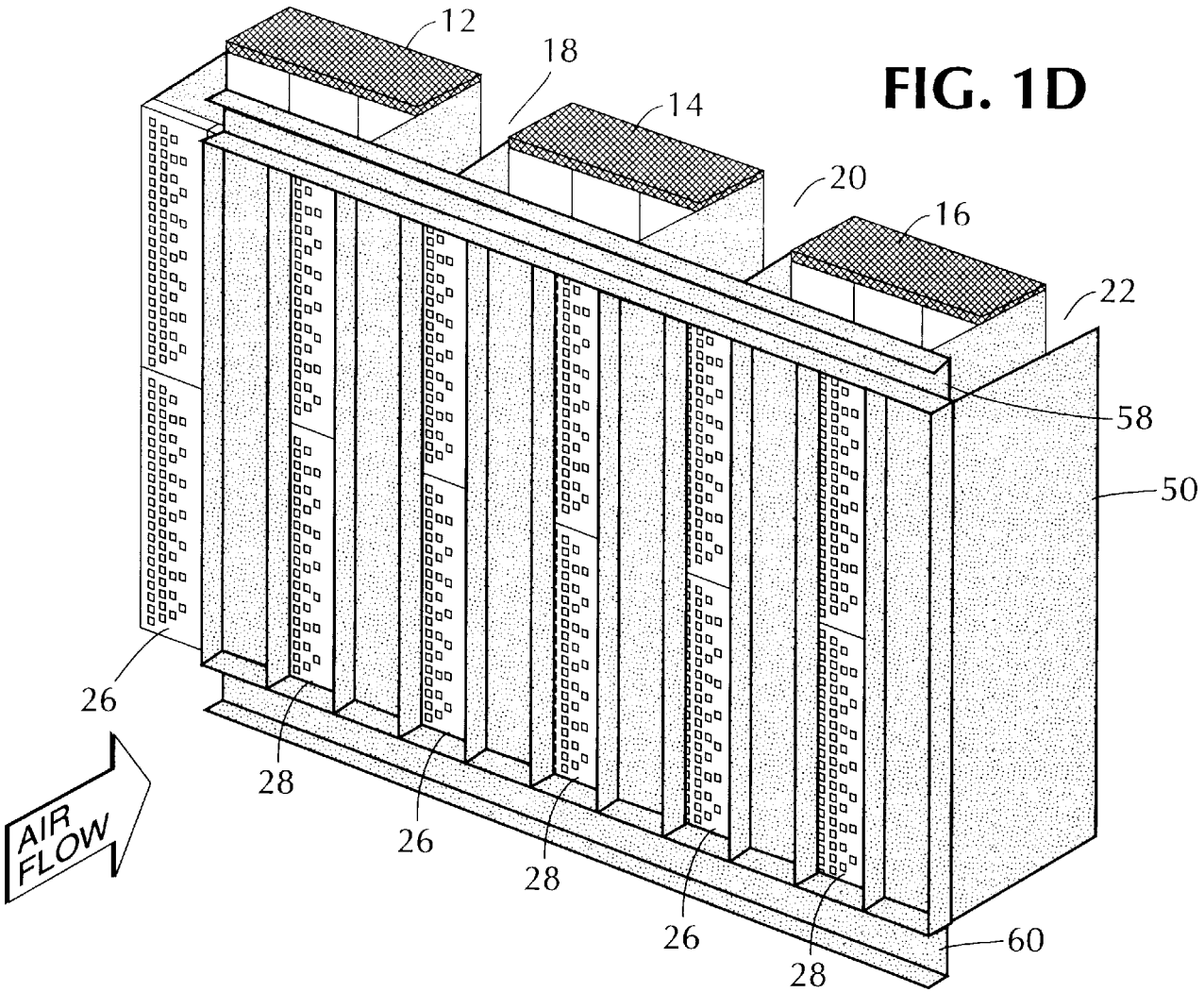
FIG. 1D is a view similar to FIGS. 1B and 1C showing another position of operation.

This is illustrated in FIGS. 1B to 1D where FIG. 1B illustrates the condition where moveable panels 36–46 are positioned to block all air from flowing through the conditioning cores 12–16 so that the total volume of incoming air flows through the bypass sections 18–22. FIG. 1C illustrates the condition where moveable panels 36–46 are at an intermediate position to permit a portion of the incoming air volume to flow through the conditioning cores 12–16 and a portion of the incoming air volume to pass through the bypass sections 18–22. FIG. 1D illustrates the condition where moveable panels 36–46 are positioned to block all air flow through the bypass sections 18–22 so that the total volume of incoming air is directed through the conditioning cores 12–16.

Reference is now made to FIGS. 2–7 as well for a description of preferred embodiments of the invention where similar parts described therein have the same reference numerals as previously used.

Figure 2:
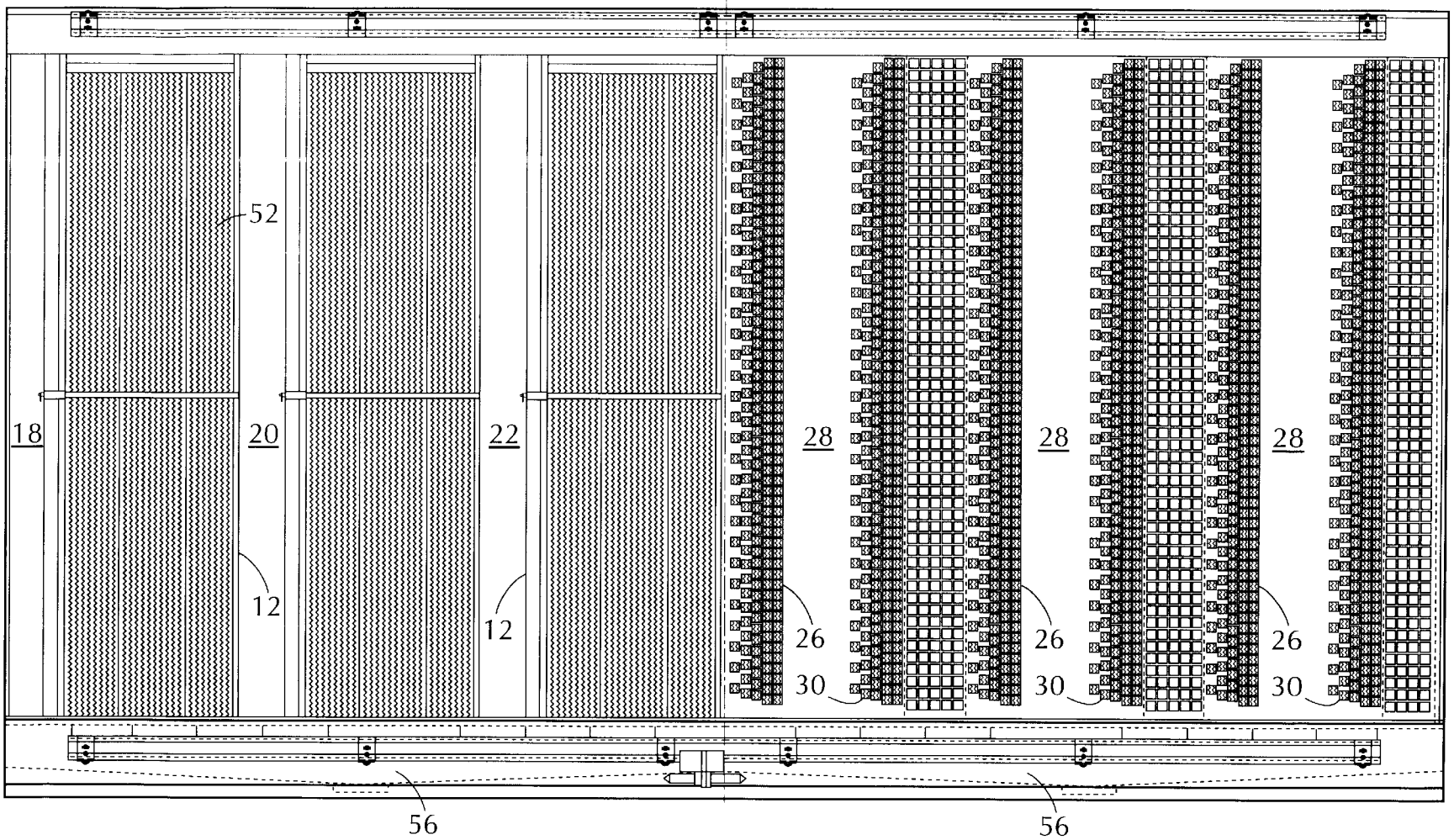
FIG. 2 is a split elevational view showing one preferred HVAC system and the perforated plates used in one preferred embodiment of the invention.

With reference initially to FIG. 2, the left hand portion of the figure shows a preferred embodiment where the conditioning core 12 is an evaporative humidifier having typical corrugated absorbent media 52 disposed within the core. The media absorbs water distributed through water distribution pipes 54 (See FIG. 4) which flows over the media 52 where it is absorbed. Unabsorbed water is collected in a sump 56 for recirculation.

As described previously, on each side of the humidification units are the bypass air passages 18–22 which permit incoming air, when moveable panels 36–46 are in an appropriate position, to block air flow through the bypass passages so that air flows through the humidification section. As shown in the left hand portion of FIG. 2, it is not necessary, according to the present invention, to provide perforated plates over the humidification unit or bypass passages. However, such perforated plates, as will be explained, are desirable for optimum operating conditions.

The right hand portion of FIG. 2, illustrates another embodiment of the present invention and illustrates the disposition of the perforated and blanking plates of the present invention as positioned in front of the conditioning cores and bypass passages. As illustrated here a perforated plate 26, a blanking plate 28 and a perforated plate 30 are disposed in front of a humidification unit 12. The perforations may be of any size to control the airflow through the conditioning media and the size for the perforation is selected based on designed flow rate capacity of the incoming air. It has also been found that a non-uniform spacing between perforations is beneficial. As shown in FIG. 2, one side of perforated plates 26 and 30 have more widely spaced perforations than does the other side where the perforations are more closely spaced. The side of the plate with the wider spaced perforations is the side of the plate which will be exposed first when a moveable panel moves from the complete air flow blocking position to an open position. The gradual increase in air flow through a conditioning unit reduces air surges and improves pressure regulation.

Figure 3:
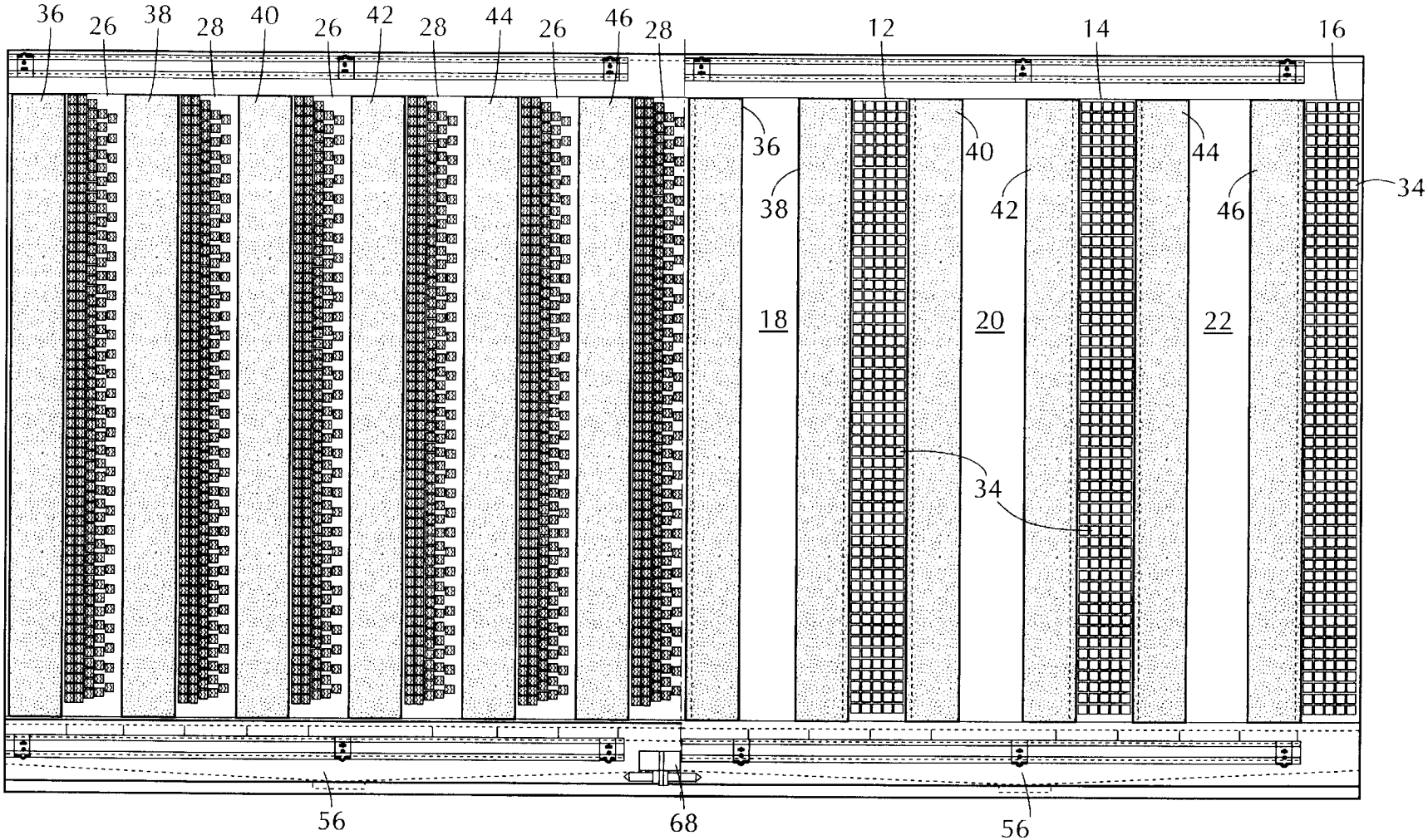
FIG. 3 is a split elevational view showing different positions of a preferred embodiment of the present invention.
Figure 4:
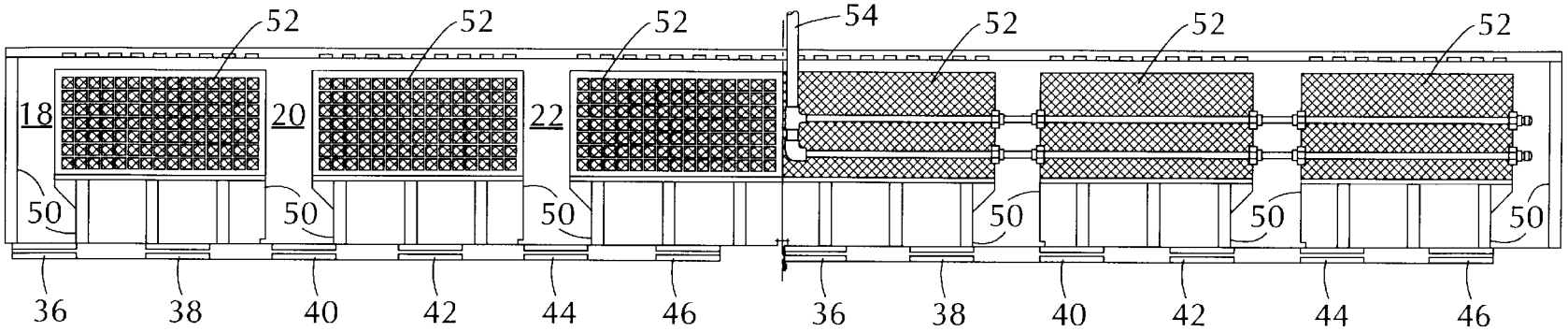
FIG. 4 is a split plan and partial sectional view of a preferred embodiment of the present invention.
Figure 5:
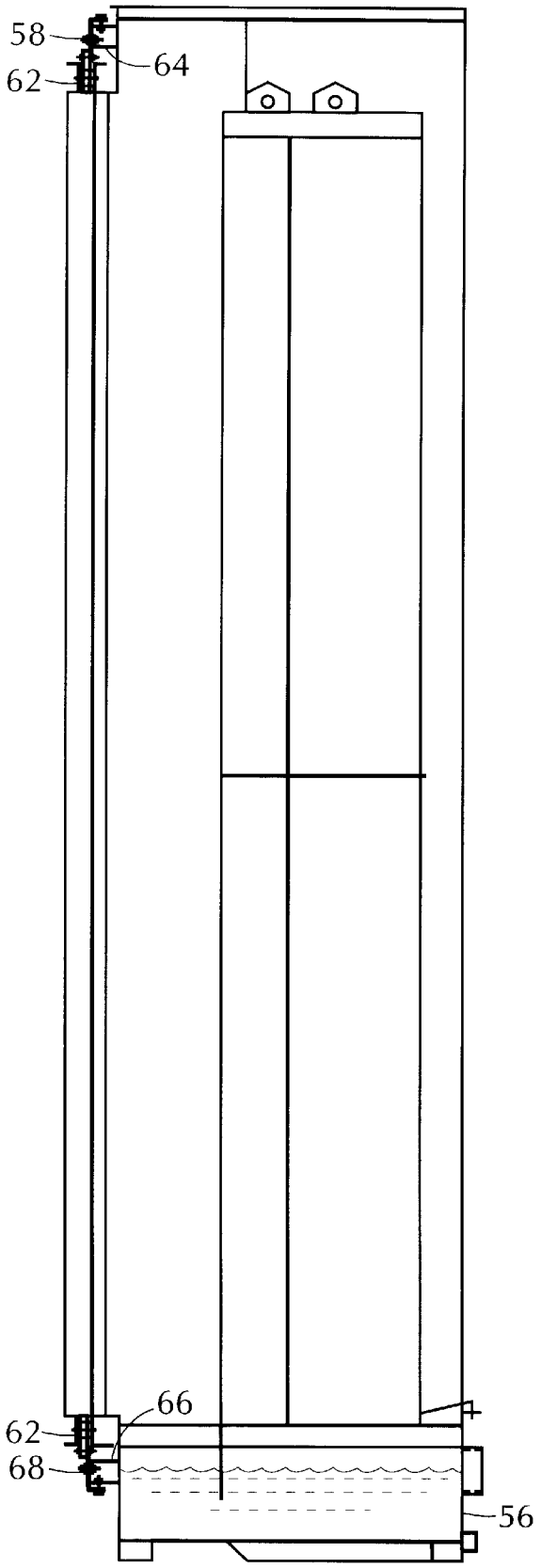
FIG. 5 is an end elevational view of a preferred embodiment of the present invention.

Reference is now made to FIG. 3 which illustrates, in split view, the first and second position of the moveable panels. The left side of FIG. 3 shows the moveable panels 36–46 completely blocking the bypass sections so that the total volume of incoming air will pass through perforated plates 26 and 28 in front of the conditioning core.

The right side of FIG. 3 illustrates the second position of the moveable panels where panels 36–46 are now completely blocking air flow into the conditioning cores 12–16, exposing the bypass passages 18–22, with perforated plate 34 thereacross. In this position all of the volume of incoming air will pass through the bypass passages and none through the conditioning cores.

Reference is now made to FIGS. 2, 3, 4 and 5 for a brief explanation of how the moveable panels 36–46 are positioned and moved. It is evident that the panels may be slidably mounted and moved in any manner. For example, the panels could be mounted on rollers on either single or double tracks and moved by any desired mechanical or electrical means. The panels could be manually driven, gear driven, pneumatically driven or electrically driven. In a preferred embodiment the moveable panels 36–46 are slidably mounted on track assembly 48 which consists of upper 58 and lower 60 guide tracks (See FIG. 1 as well).

Preferably, the panels ride on v-groove rollers 62 mounted to the upper and lower ends of each panel 36–48 which ride in v-groove tracks 64 and 66, respectively, on the upper guide rail 58 and lower guide rail 60.

Preferably a linear actuator 68 (FIG. 3) may be employed to move the moveable panels between the first and second positions although any type of actuator may be employed.

The position of moveable panels 36–46 can be determined in any convenient manner as will be evident to one of ordinary skill in the HVAC art. Sensors, not shown, may be used to sense the temperature and humidity level of incoming air as well as air down stream of the air handling and conditioning unit which is to be distributed in the building. A microprocessor, not shown, processes the data from the upstream and downstream sensors and issues a control signal to the linear actuator 68 which moves the panels to the appropriate position in response to the sensed conditions.

The size and spacing of the perforations 32 in the perforated plates 26, 30 and 34 are selected to minimize the pressure differential of the air flowing through the conditioning media and the bypass so that the pressure differential remains substantially uniform. It has been found that the static pressure drop across the media section and the bypass section and the perforations is proportional to the square of the velocity through each section. Thus, as the velocity across the media section increases, the velocity across the perforations on the opening of the media section must decrease accordingly to maintain the same pressure. At the same time, the static pressure across the bypass may be maintained by assuring the velocity through the bypass perforations is maintained, i.e. as more air is diverted to the bypass, a proportional number of perforations are exposed by the moveable panel.

The relationship is as follows where:

$P_S$=System static pressure $P_M$=Media static pressure $P_{PM}$=Perforation static pressure (Media)

$P_B$=Bypass static pressure $P_{PB}$=Perforation static pressure (bypass)

$$P_S=P_M+P_{PM}=P_B+P_{PB}$$

As the panel moves $P'_S=P'_M+P'_{PM}=P'_B+P_{PB}$

When varying velocity (V) across a section, at any point of media, perforations or bypass the new pressure $$P' = \left(P\left(\frac{V'}{V}\right)\right)^2$$

$$P'_s = \left(P_m\left(\frac{V'm}{Vm}\right)\right)^2 + \left(P_{pm}\left(\frac{V'pm}{Vpm}\right)\right)^2 = \left(P_B\left(\frac{V'b}{Vb}\right)\right)^2 + \left(P_{pb}\left(\frac{V'pb}{Vpb}\right)\right)^2$$

By varying the size of the perforations or the door opening the velocities can be adjusted to maintain the desired static pressure drop at each point.

Thus by proper sizing and spacing of the perforations in the perforated plate across the bypass passages one can maintain a consistent and uniform pressure drop across the media and the bypass air passages. This will significantly help in linear proportioning of the air flowing through the media and the bypass passages and assure minimal changes in static pressure variations as the moveable panels open and close air flow.

Figure 6:
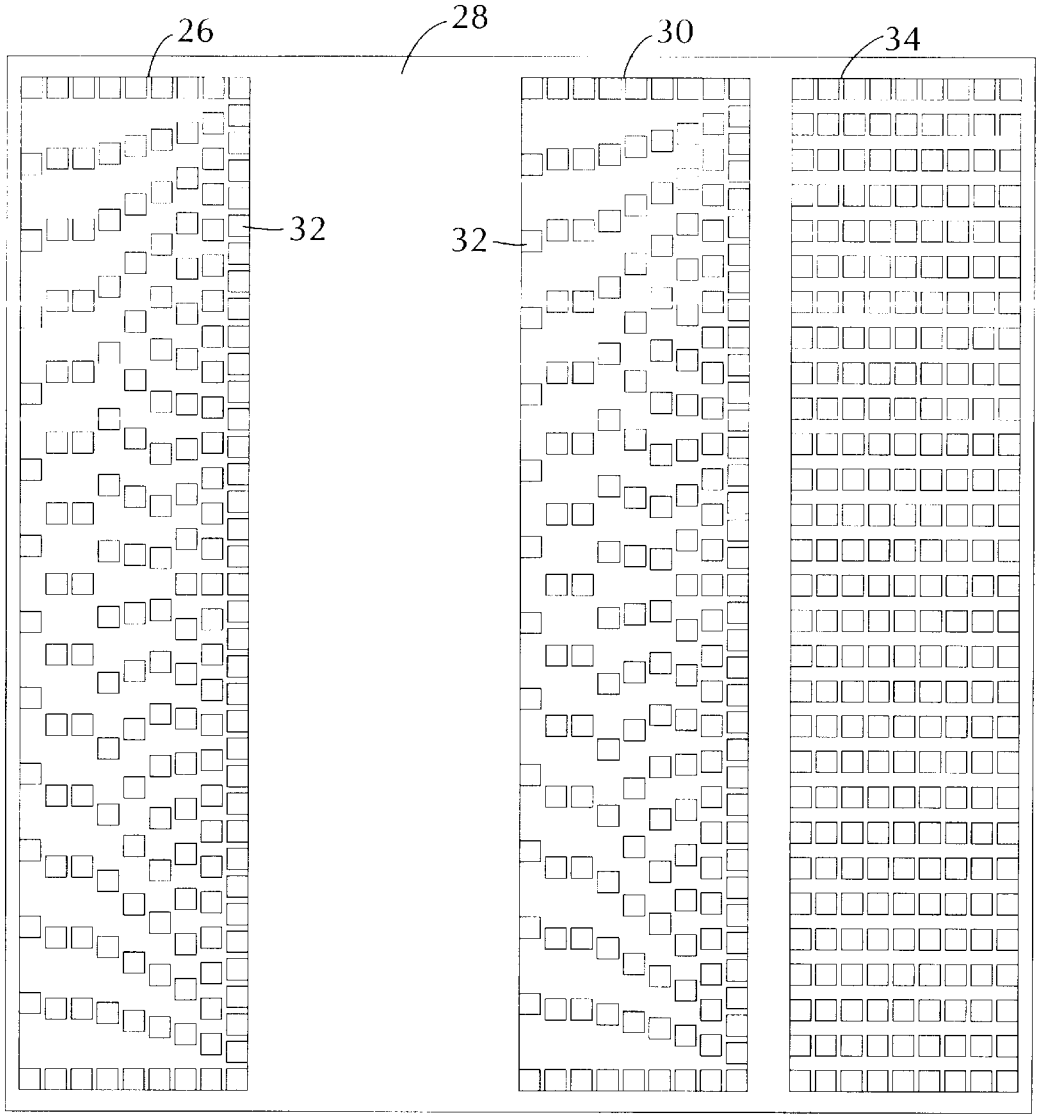
FIGS. 6 and 7 are elevational views of alternative damper plates used in a preferred embodiment showing alternate arrangements for the perforations.
Figure 7:
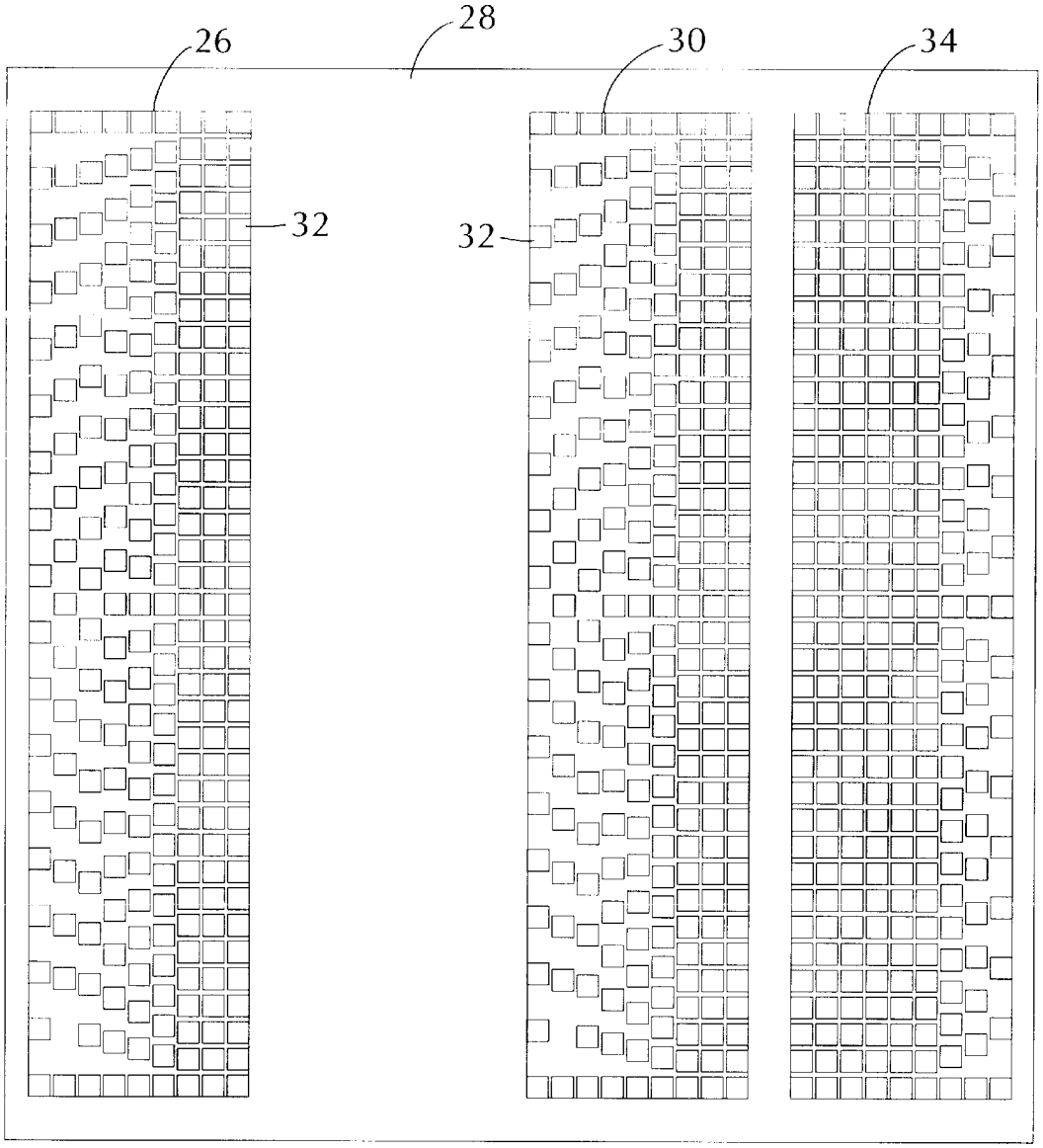

FIGS. 6 and 7 illustrate that different arrangements may be employed for the location and orientation of the perforations 32 in the perforated plates 26, 30 and 34. FIGS. 6 and 7 are but just two suggested dispersal patterns among many which can be determined based on air volumes being passes through the system.

FIG. 6 illustrates a pattern where there is a relatively wide dispersion in perforations at the initial exposure position of the plate to a denser but still widely dispersed pattern at the other side.

FIG. 7 illustrates, in like manner, another dispersion pattern which starts with an initial dispersion widely spread but denser than in FIG. 6 and ends with a more dense pattern than in FIG. 6.

What is claimed is:

1. An air handling system for an air treatment system comprising:

a plurality of air treatment sections to condition a volume of air flow therethrough, a plurality of air bypass sections respectively positioned adjacent said air treatment section to provide an air flow path for air to bypass said air treatment sections, a plurality of moveable panel members selectively moveable between first positions in front of said air treatment sections to block the flow of air to said air treatment sections to second positions to block the flow of air through said bypass sections, whereby selected positioning of said moveable panel members between said first and second positions varies the volume of air flowing through said air treatment sections and said bypass sections to selectively vary the volume of air to be treated in said air treatment sections;

and a perforated plate means disposed upstream of said air flow direction in front of said air treatment section and behind said plurality of moveable panel members;

said perforated plate means having both perforated and unperforated sections located upstream of said air treatment means and perforated sections upstream of said bypass sections, said plurality of moveable panel members being arranged to align in their first position with the perforated sections of the plate means upstream of said air treatment means and in their second position to align with the unperforated sections of the plate means upstream of said air treatment means and with the perforated section of the plate means upstream of said bypass section.

2. The air handling system as defined in claim 1 including a plurality of side panel members adjacent each said air treatment section to define air flow paths through said air treatment sections and through said bypass sections.

3. The air handling system as defined in claim 2 wherein said plurality of moveable panels are slidably mounted to slide transverse to the direction of air flow through said system and are disposed in air sealing engagement with said side panel members to limit air flow through said air treatment section when in said first position and to limit air flow through said bypass sections when in said second position.

4. An air handling system for an air treatment system comprising:

at least one air treatment section to condition a volume of air flow therethrough, a bypass section adjacent said air treatment section to provide an air flow path for air to bypass said air treatment section, a moveable panel member selectively moveable between a first position in front of said air treatment section to block the flow of air to said air treatment section and a second position to block the flow of air through said bypass section, whereby selected positioning of said moveable panel member varies the volume of air flowing through said air treatment section and said bypass section to selectively vary the volume of air to be treated in said air treatment section;

wherein there are a plurality of air treatment sections, a plurality of bypass sections, and a plurality of moveable panels;

a perforated plate disposed upstream of the air flow section in front of said air treatment section; and wherein the perforations in said perforated plate are not uniformly spaced and wherein said perforations are more widely spaced in that portion of said perforated plate which is first exposed to the flow of air as said moveable panels begin movement from the first air blocking position to its said second position.

5. The air handling system as defined in claim 4 wherein said air treatment section is an air humidifying treatment section.

6. The air handling system as defined in claim 4 wherein said air treatment section is an air cooling section.

7. The air handling system as defined in claim 4 wherein said air treatment section is an air heating section.

8. The air handling system as defined in claim 4 wherein said air treatment section is an air dehumidifying section.

9. The air handling system as defined in claim 4 wherein said air treatment section is an air cooling, air heating, humidifying and dehumidifying section.

10. An air handling system for an air treatment means to vary the flow of air between said air treatment means and air bypass sections therein where ambient air flows through the system without treatment to be mixed downstream of said air handling system with the volume of air treated in said air treatment means comprising:

a plurality of air treatment means for treating ambient air flowing therethrough by heating, cooling, humidifying or dehumidifying air flowing therethrough;

a plurality of bypass sections respectively located adjacent said air treatment means to direct ambient air flow to bypass said air treatment means;

means for selectively diverting the ambient air flowing through said air handling system from a first air flow path where all of the volume of incoming ambient air flows through said air treatment means to a second air flow path where all of the volume of incoming ambient air flows untreated through said bypass section; and wherein at intermediate positions between said first and second positions said means for selectively diverting the ambient air directs varying volumes of ambient air to flow through said air treatment means and said bypass section so that the volume of air flowing through said air treatment means is treated by being cooled, heated, humidified or dehumidified and the volume of air flowing through said bypass section is untreated;

plate means disposed upstream of the air flow direction in front of said air treatment means having air flow and air blocking sections therein located upstream of said air treatment means and air flow sections upstream of said bypass sections;

said means for selectively diverting ambient air comprising a plurality of panels mounted to move transversely of the plate means and arranged to align in their first position with the air flow sections of the plate means upstream of said air treatment means and in their second position to align with the air blocking sections of the plate means upstream of the air treatment means and the air flow section of the plate means upstream of the bypass sections.

11. An air handling system as defined in claim 10 wherein there are a plurality of air treatment means and a plurality of air bypass sections.

12. An air handling system as defined in claim 11 wherein said means to selectively divert the ambient air flowing through said air handling systems comprises a plurality of panel members disposed transverse to the direction of air flowing through said system upstream of said air treatment means and said bypass sections and selectively moveable from a first position blocking air flow through said bypass sections to a second position blocking air flow through said air treatment means and wherein at intermediate positions between said first and second positions varying volumes of air flow through said air treatment means and said bypass sections to be mixed downstream of said air handling system.

13. An air handling system for an air treatment means to vary the flow of air between said air treatment means and an air bypass section where ambient air flows through the system without treatment to be mixed downstream of said air handling system with the volume of air treated in said air treatment means comprising:

at least one air treatment means for treating ambient air flowing therethrough by heating, cooling, humidifying or dehumidifying air flowing therethrough;

a bypass section adjacent said air treatment means to direct ambient air flow to bypass said air treatment means;

means to selectively divert the ambient air flowing through said air handling system from a first air flow path where all of the volume of incoming ambient air flows through said air treatment means to a second air flow path where all of the volume of incoming ambient air flows untreated through said bypass section; and wherein at intermediate positions between said first and second positions said means for selectively diverting the ambient air directs varying volumes of ambient air to flow through said air treatment means and said bypass section so that the volume of air flowing through said air treatment means is treated by being cooled, heated, humidified or dehumidified and the volume of air flowing through said bypass section is untreated;

a plurality of air treatment means and a plurality of air bypass sections;

said means for selectively diverting the ambient air flowing through said air handling systems comprising a plurality of panel members disposed transverse to the direction of air flowing through said system upstream of said air treatment means and said bypass sections are selectively from said first position blocking air flow through said bypass sections to a second position blocking air flow through said air treatment means and wherein at intermediate positions between said first and second positions varying volumes of air flow through said air treatment means and said bypass sections to be mixed downstream of said air handling system; and means upstream of said air treatment means and said air bypass section for controlling the differential pressure of air flowing through said air treatment means and said air bypass section.

14. An air handling system as defined in claim 13 wherein said means for controlling the differential pressure includes a plate member having spaced perforations through which air flows.

15. An air handling system as defined in claim 14 wherein said perforations in said plate member are not uniformly spaced throughout said plate member.

16. An air handling system as defined in claim 15 wherein said perforations in said plate member are more widely spaced in the area of said plate member which is exposed first as said panel members begin to move from said first position to said second position than are the perforations in the remainder of the plate member.

17. An air handling system as defined in claim 16 wherein the spacing between said perforations in said plate member progressively decrease across said plate member.

* * * * *